US008776539B2

(12) United States Patent
Verma et al.

(10) Patent No.: US 8,776,539 B2
(45) Date of Patent: Jul. 15, 2014

(54) EJECTOR-TYPE REFRIGERATION CYCLE AND REFRIGERATION DEVICE USING THE SAME

(75) Inventors: Parmesh Verma, Manchester, CT (US); Jinliang Wang, Ellington, CT (US)

(73) Assignee: Carrier Corporation, Farmington, CT (US)

( * ) Notice: Subject to any disclaimer, the term of this patent is extended or adjusted under 35 U.S.C. 154(b) by 128 days.

(21) Appl. No.: 13/521,753

(22) PCT Filed: Jul. 20, 2011

(86) PCT No.: PCT/US2011/044610

§ 371 (c)(1), (2), (4) Date: Jul. 12, 2012

(87) PCT Pub. No.: WO2012/012485

PCT Pub. Date: Jan. 26, 2012

(65) Prior Publication Data

US 2012/0291461 A1 Nov. 22, 2012

Related U.S. Application Data

(60) Provisional application No. 61/367,109, filed on Jul. 23, 2010.

(51) Int. Cl.
*F25B 1/00* (2006.01)

(52) U.S. Cl.
USPC ..... 62/115; 62/500

(58) Field of Classification Search
CPC .... F25B 41/06; F25B 49/022; F25B 2400/05; F25B 2341/0012; F25B 41/00; F25B 43/006; F25B 43/003; F25B 39/04; F25B 40/02; F25B 40/00; F25B 2400/13
USPC ..... 62/115, 500, 510, 503, 509, 513; 417/151; 165/908
See application file for complete search history.

(56) References Cited

U.S. PATENT DOCUMENTS 1,836,318 A 12/1931 Gay
3,277,660 A 10/1966 Kemper et al.

(Continued)

FOREIGN PATENT DOCUMENTS

JP 2001-221517 A 8/2001
WO 2008/130412 A1 10/2008
WO 2009/128271 A1 10/2009

OTHER PUBLICATIONS

International Search Report and Written Opinion for PCT/US2011/044610, dated Oct. 19, 2011.

*Primary Examiner* — Mohammad M Ali
(74) *Attorney, Agent, or Firm* — Bachman & LaPointe, P.C.

(57) ABSTRACT

A system has first and second compressors (22, 180), a heat rejection heat exchanger (30), an ejector (38), a heat absorption heat exchanger (64), and a separator (48). The heat rejection heat exchanger (30) is coupled to the compressor to receive refrigerant compressed by the compressor. The ejector (38) has a primary inlet (40) coupled to the heat rejection exchanger (30) to receive refrigerant, a secondary inlet (42), and an outlet (44). The separator (48) has an inlet coupled to the outlet of the ejector to receive refrigerant from the ejector. The separator has a gas outlet (54) coupled to the compressor (22) to return refrigerant to the first compressor. The separator has a liquid outlet (52) coupled to the secondary inlet of the ejector to deliver refrigerant to the ejector (38). The heat absorption heat exchanger (64) is coupled to the liquid outlet of the separator to receive refrigerant. The second compressor (180) is between the separator and the ejector secondary inlet.

12 Claims, 6 Drawing Sheets

(56) References Cited

U.S. PATENT DOCUMENTS

| | | | | |
|---|---|---|---|---|
| 3,742,726 | A | 7/1973 | English | |
| 3,932,158 | A | 1/1976 | Hildebrandt | |
| 4,242,885 | A | 1/1981 | Quack et al. | |
| 4,748,826 | A | 6/1988 | Laumen | |
| 6,550,265 | B2 | 4/2003 | Takeuchi et al. | |
| 6,675,609 | B2 * | 1/2004 | Takeuchi et al. | 62/500 |
| 7,377,126 | B2 | 5/2008 | Gorbounov et al. | |
| 7,428,826 | B2 | 9/2008 | Oshitani et al. | |
| 8,158,000 | B2 * | 4/2012 | Newman et al. | 210/322 |
| 2003/0140651 | A1 | 7/2003 | Takeuchi et al. | |
| 2004/0123624 | A1 | 7/2004 | Ohta et al. | |
| 2005/0188720 | A1 | 9/2005 | Jansen | |
| 2006/0182680 | A1 * | 8/2006 | Keefer et al. | 423/651 |
| 2007/0028630 | A1 | 2/2007 | Yamada et al. | |
| 2007/0186572 | A1 | 8/2007 | Nishida et al. | |
| 2008/0196446 | A1 | 8/2008 | Nakamura et al. | |
| 2009/0095003 | A1 * | 4/2009 | Nagano et al. | 62/217 |
| 2009/0232665 | A1 * | 9/2009 | Gocho et al. | 417/151 |
| 2010/0162751 | A1 * | 7/2010 | Nishijima et al. | 62/500 |
| 2011/0005268 | A1 | 1/2011 | Oshitani et al. | |

* cited by examiner

EJECTOR-TYPE REFRIGERATION CYCLE AND REFRIGERATION DEVICE USING THE SAME

CROSS-REFERENCE TO RELATED APPLICATION

Benefit is claimed of U.S. Patent Application Ser. No. 61/367,109, filed Jul. 23, 2010, and entitled "High Efficiency Ejector Cycle", the disclosure of which is incorporated by reference herein in its entirety as if set forth at length.

BACKGROUND

The present disclosure relates to refrigeration. More particularly, it relates to ejector refrigeration systems.

Earlier proposals for ejector refrigeration systems are found in U.S. Pat. No. 1,836,318 and U.S. Pat. No. 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Various modifications of such ejector systems have been proposed. One example in US20070028630 involves placing a second evaporator along the line 46. US20040123624 discloses a system having two ejector/evaporator pairs. Another two-evaporator, single-ejector system is shown in US20080196446. Alternatively, in non-ejector systems, economized systems have been proposed which split the compression process. Additionally, WO2008/130412 discloses use of a separate booster circuit which may be used with economized and non-economized systems. Another method proposed for controlling the ejector is by using hot-gas bypass. In this method a small amount of vapor is bypassed around the gas cooler and injected just upstream of the motive nozzle, or inside the convergent part of the motive nozzle. The bubbles thus introduced into the motive flow decrease the effective throat area and reduce the primary flow. To reduce the flow further more bypass flow is introduced.

SUMMARY

One aspect of the disclosure involves a system having first and second compressors, a heat rejection heat exchanger, an ejector, a heat absorption heat exchanger, and a separator. The heat rejection heat exchanger is coupled to the compressor to receive refrigerant compressed by the compressor. The ejector has a primary inlet coupled to the heat rejection exchanger to receive refrigerant, a secondary inlet, and an outlet. The separator has an inlet coupled to the outlet of the ejector to receive refrigerant from the ejector. The separator has a gas outlet coupled to the compressor to return refrigerant to the first compressor. The separator has a liquid outlet coupled to the secondary inlet of the ejector to deliver refrigerant to the ejector. The heat absorption heat exchanger is coupled to the liquid outlet of the separator to receive refrigerant. A second compressor is between the separator and the ejector secondary inlet.

In various implementations, the ejector may be a first ejector and the separator may be a first separator. The system may further include a second separator and a second ejector. The second separator may have an inlet, a gas outlet coupled to the secondary inlet of the first ejector via the second compressor, and a liquid outlet. The second ejector may have a primary inlet coupled to the liquid outlet of the first separator to receive refrigerant, a secondary inlet coupled to the outlet of the heat absorption heat exchanger, and an outlet coupled to the inlet of the second separator. One or both separators may be gravity separators. The system may have no other separator (i.e., the two separators are the only separators). The system may have no other ejector. This system may have no other heat absorption heat exchanger. An expansion device may be immediately upstream of the heat absorption heat exchanger. The refrigerant may comprise at least 50% carbon dioxide, by weight.

Other aspects of the disclosure involve methods for operating the system.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 3:
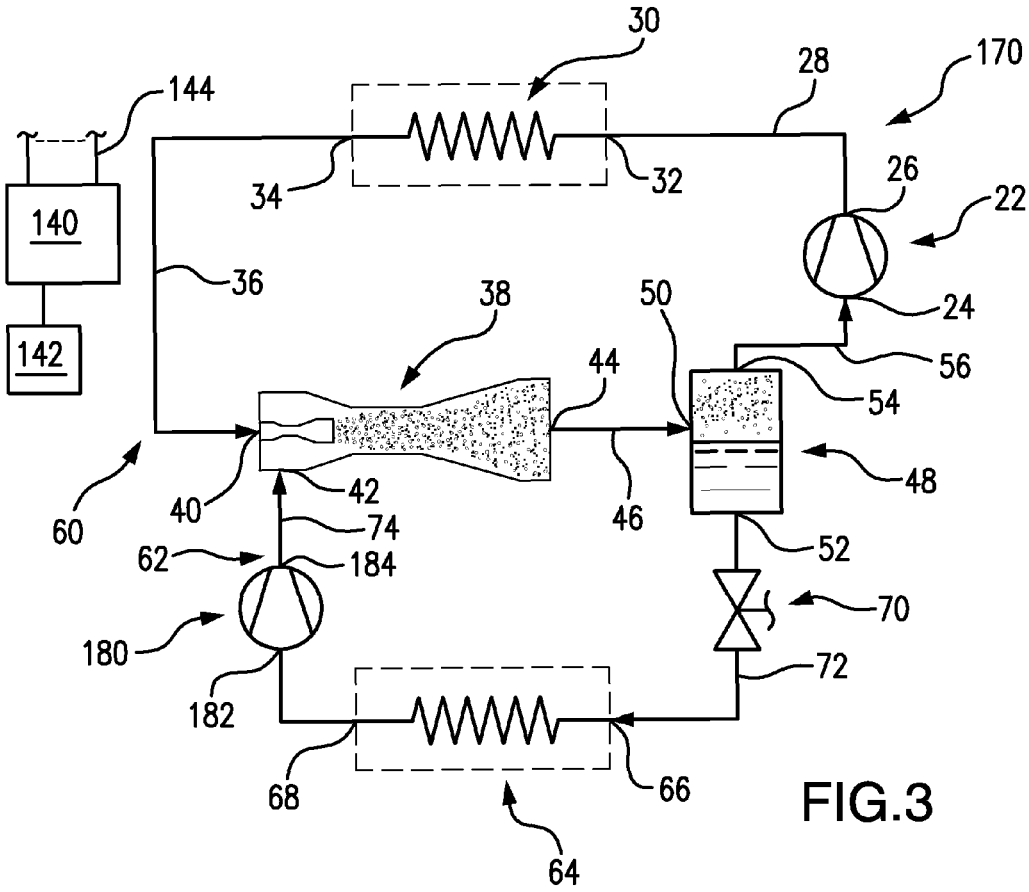
FIG. 3 is a schematic view of a first refrigeration system.

FIG. 3 shows an ejector cycle vapor compression (refrigeration) system 170. The system 170 may be made as a modification of the system 20 or of another system or as an original manufacture/configuration. In the exemplary embodiment, like components which may be preserved from the system 20 are shown with like reference numerals. Operation may be similar to that of the system 20 except as discussed below with the controller controlling operation responsive to inputs from various temperature sensors and pressure sensors.

Figure 1:
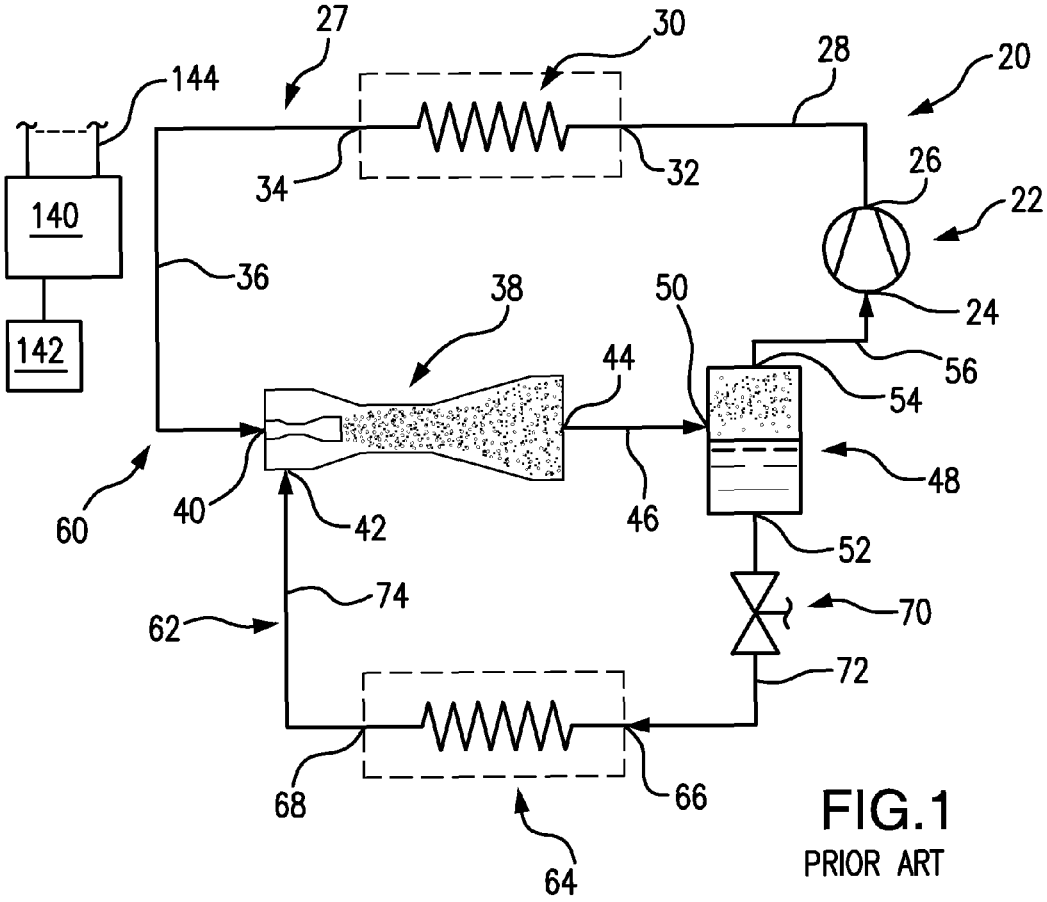
FIG.1 PRIOR ART
FIG. 1 is a schematic view of a prior art ejector refrigeration system.
Figure 2:
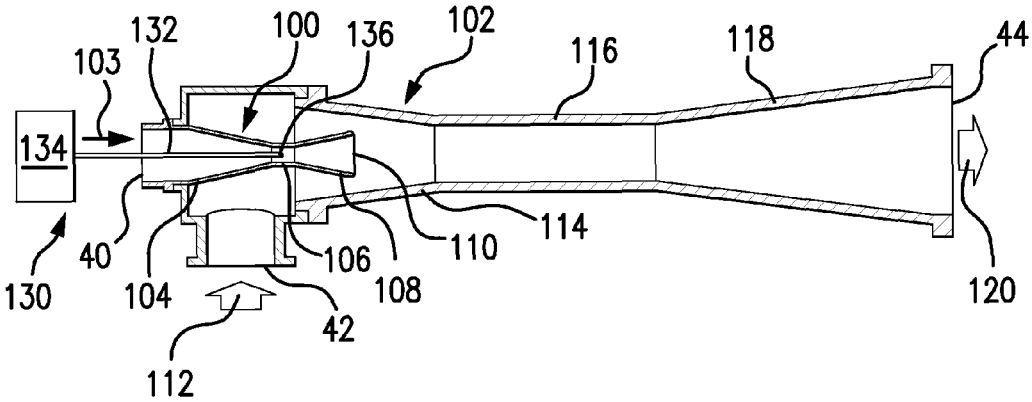
FIG. 2 PRIOR ART
FIG. 2 is an axial sectional view of an ejector.

The compressor 22 is a first compressor and the system further includes a second compressor 180 having a suction port (inlet) 182 and a discharge port (outlet) 184. The second compressor 180 is positioned along the line 74 between the evaporator outlet 168 and the ejector secondary inlet 42. Relative to the baseline system of FIG. 1, use of the second compressor 180 permits an increase in vapor pressure entering the ejector secondary inlet. The exemplary second compressor operates at a lower pressure ratio than the first compressor 22 (e.g., 10-80% or, more narrowly, 30-60% of the pressure ratio of the first compressor) and with a lower mass flow rate and (e.g., 10-90% or, more narrowly, 30-70% of the mass flow of the first compressor) a lower pressure increase ($\Delta P$) than the first compressor (e.g., 5-45%, more narrowly, 15-35% of the $\Delta P$ of the first compressor).

Figure 4:
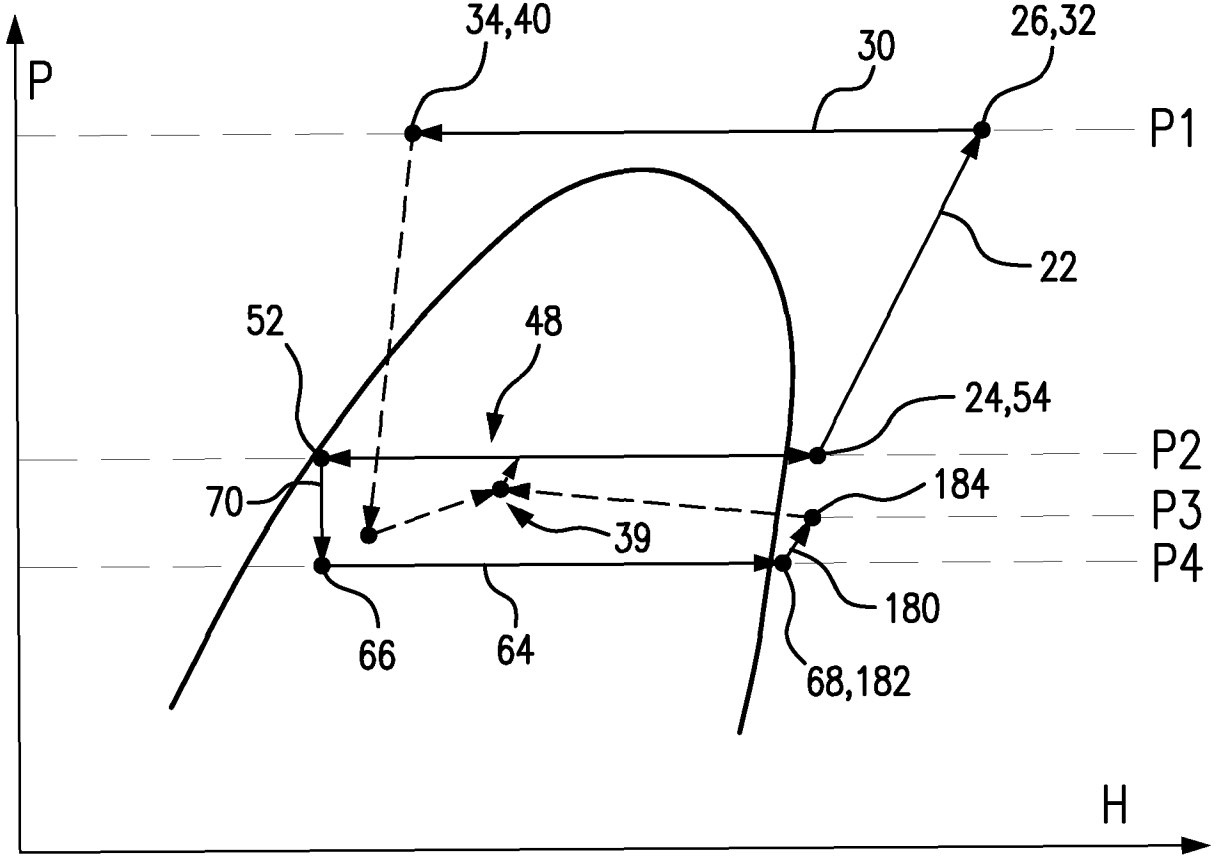
FIG. 4 is a pressure-enthalpy (Mollier) diagram of the system of FIG. 3.

FIG. 4 is a Mollier diagram of the system of FIG. 3. P1 represents the exemplary discharge pressure of the first compressor 22 and operating pressure of the gas cooler 30 (high side pressure). P2 represents the suction pressure of the first compressor 22 and the operating pressure of the separator. P3 represents the operating pressure of the evaporator 64 (low side pressure) and the suction pressure of the second compressor 180. P4 represents the discharge pressure of the second compressor. Operation may be contrasted with that of the system of FIG. 1 configured to provide the same gas cooler and evaporator pressures. In the FIG. 1 system, the ejector may provide a boost approximately similar to the FIG. 4 boost (P2 minus P4) so that the FIG. 1 compressor accounts for approximately the same total pressure change as the two FIG. 3 compressors. However, each of the FIG. 3 compressors operates at a lower pressure ratio than does the FIG. 1 compressor. This may provide for improved compressor efficiency and, thereby, improved total cycle efficiency. In addition, the pressure ratios of first and second compressors can be optimized to maximize the total cycle efficiency. For the first compressor the pressure increase (P1-P2) may be about 45-90%, more narrowly 55-75%, of the total pressure increase (P1-P3). For the second compressor the pressure increase (P4-P3) may be about 10-50%, more narrowly 20-40%, of the total pressure increase (P1-P3).

In operation speeds of both compressors may be either fixed or variable. Their speeds may be controlled by the operation inputs or control sensors in the system. The compressor may be rotary, scroll, or reciprocating, among others. Two compressors may be separate or integrated into two stage design.

Figure 5:
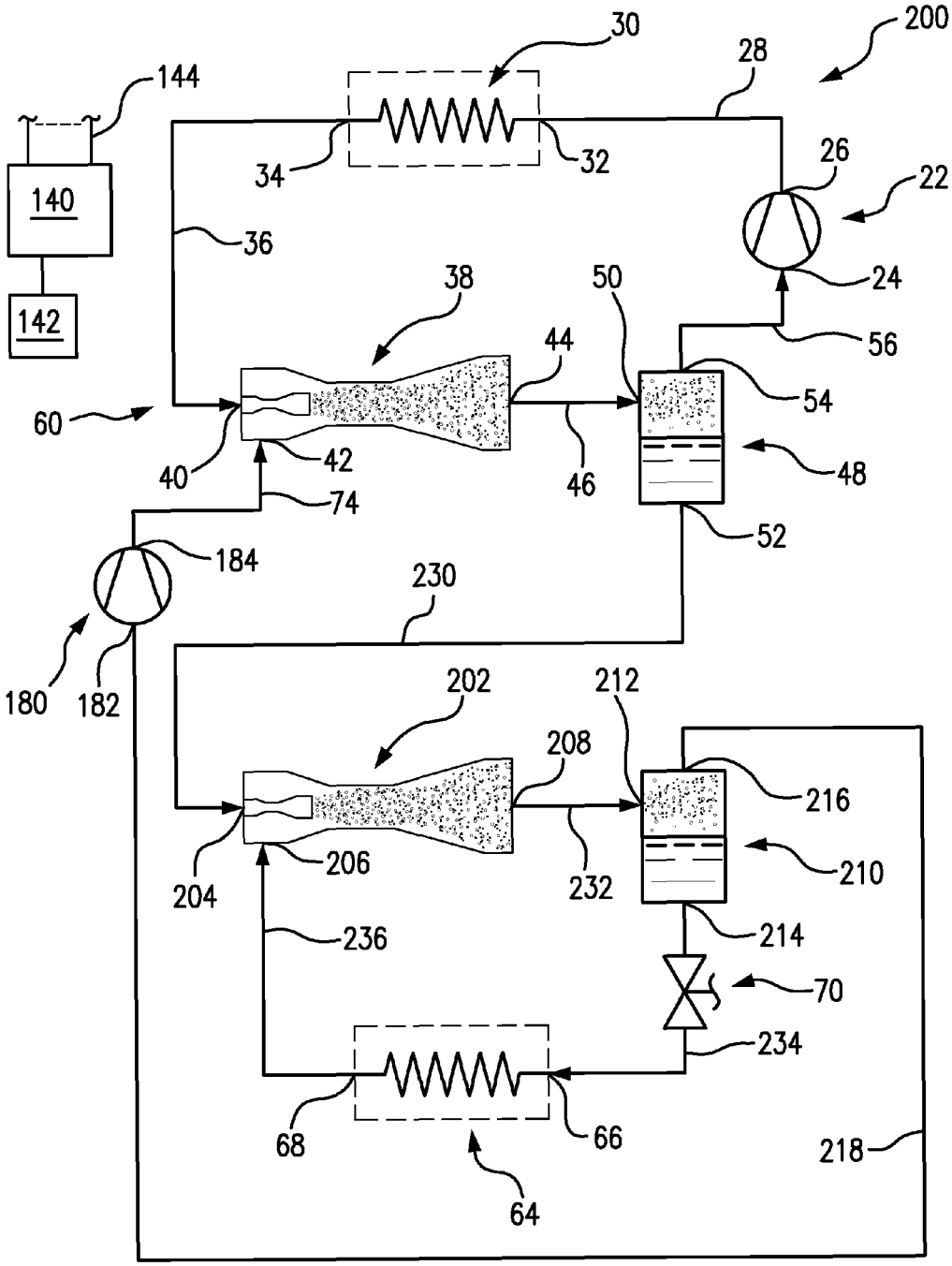
FIG. 5 is a schematic view of a second refrigeration system.

FIG. 5 shows a system 200. The system 200 may be made as a further modification of the systems of FIG. 1 or 3 or of another system or as an original manufacture/configuration. In the exemplary embodiments, like components which may be preserved from the system 170 are shown with like reference numerals. Operation may be similar to that of the system 170 except as discussed below.

The ejector 38 is a first ejector and the system further includes a second ejector 202 having a primary inlet 204, a secondary inlet 206, and an outlet 208 and which may be configured similarly to the first ejector 38.

Similarly, the separator 48 is a first separator. The system further includes a second separator 210 having an inlet 212, a liquid outlet 214, and a gas outlet 216. In the exemplary system, the gas outlet 216 is connected via a line 218 to the first ejector secondary inlet 42 and the second compressor 180 is along that line.

The second ejector primary inlet 204 receives liquid refrigerant from the first separator 48. This may be delivered via a conduit 230. The outlet flow from the second ejector passes to the second separator inlet 212 via a line 232. The expansion valve 70 is along a conduit 234 extending from the second separator liquid outlet 214 to the evaporator inlet 66. A conduit 236 connects the evaporator outlet 68 to the second ejector secondary inlet 206.

Figure 6:
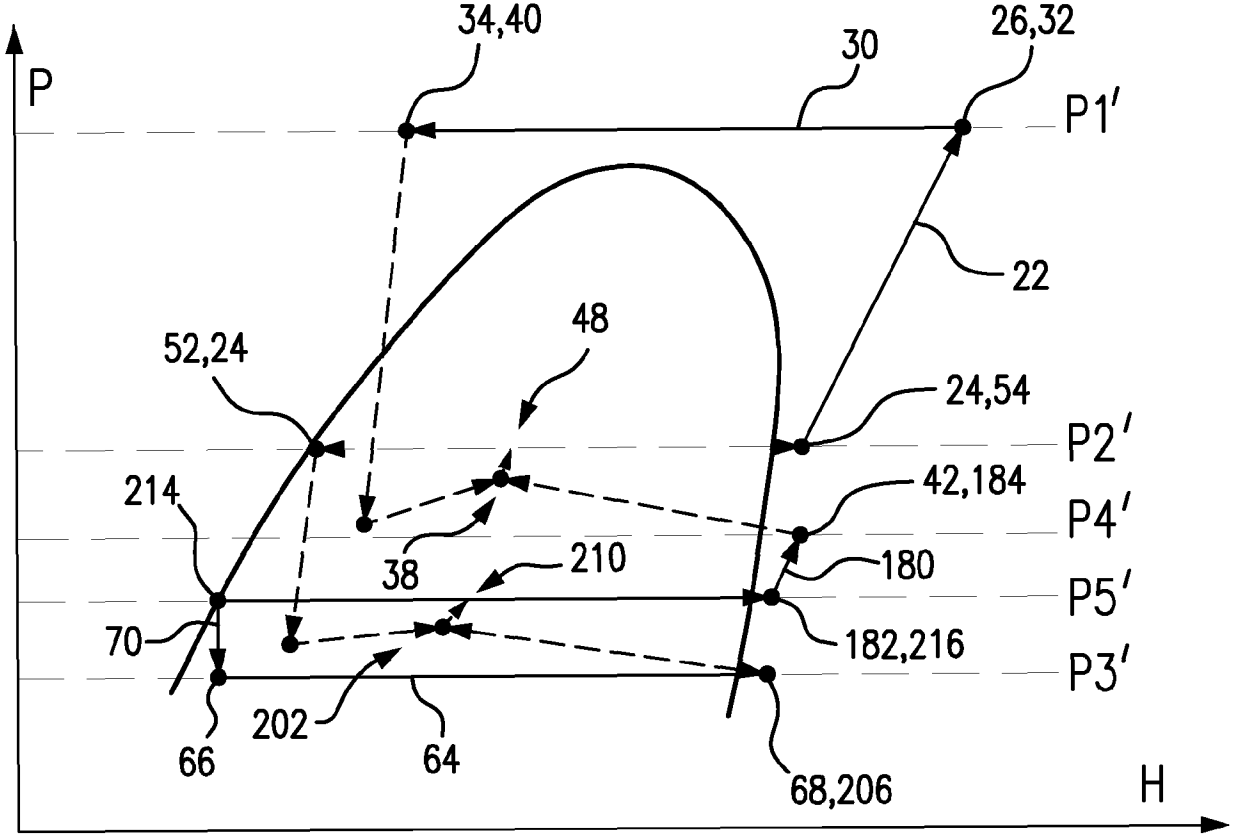
FIG. 6 is a pressure-enthalpy diagram of the system of FIG. 5.

FIG. 6 is a Mollier diagram of the system of FIG. 5. High side pressure is shown as P1'. Low side pressure is shown as P3'. This system may be particularly useful to achieve P3' lower than P3 (of FIG. 4) or may simply be used to further reduce compressor requirements. P2' represents the suction conditions of the first compressor 22 and the operating condition of the first separator 48. P5' represents the suction conditions of the second compressor 180 and the operating conditions of the second separator 200. P4' represents the discharge conditions of the second compressor 180. The ejectors 38 and 202 may account for respective pressure boosts (ΔP) of P2' minus P4' and P5' minus P3'. This combined ΔP may represent a greater total pressure and greater proportion of the total system ΔP (P1'-P3') than does the ejector of the single ejector system of FIG. 3. Such a configuration may be particularly useful for high pressure lift (system ΔP) situations such as certain transport refrigeration systems (e.g., refrigerated cargo containers, refrigerated trailers, and refrigerated trucks).

Figure 7:
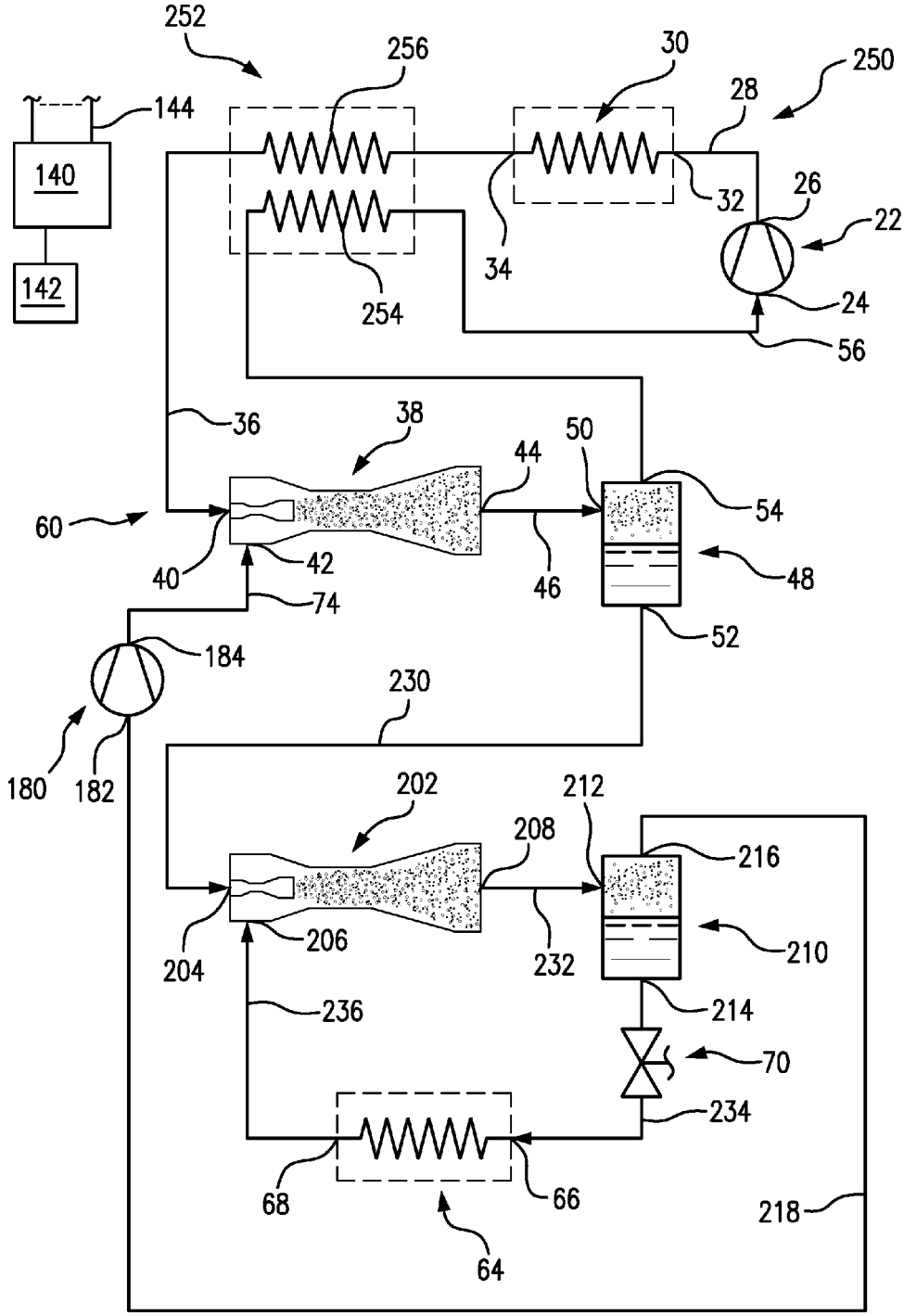
FIG. 7 is a schematic view of a third refrigeration system.

FIG. 7 shows a system 250 otherwise similar to the system 200 but featuring a suction line heat exchanger 252 having a leg 254 (heat absorption leg or cold side of refrigerant flow) along the suction line between the first separator gas outlet and the first compressor inlet. The leg 254 is in heat exchange relationship with a leg 256 (heat rejection leg or warm side of refrigerant flow) in the heat rejection heat exchanger outlet line between the heat rejection heat exchanger outlet and the first ejector primary inlet (to receive heat from the leg 256).

Among other variations, the two compressors may be physically separate (e.g., separately powered by separately-controlled motors) or may represent two fluidically independent sections of a single physical compressor. For example, in a three-cylinder compressor, two cylinders (in parallel or series) could serve as the first compressor whereas the third cylinder could serve as the second compressor. Such a compressor may be made by slightly replumbing an existing reciprocating compressor having an economizer port. In yet further variations there may be yet more compressors.

The system may be fabricated from conventional components using conventional techniques appropriate for the particular intended uses.

Although an embodiment is described above in detail, such description is not intended for limiting the scope of the present disclosure. It will be understood that various modifications may be made without departing from the spirit and scope of the disclosure. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. A system comprising:
- a first compressor;
- a heat rejection heat exchanger coupled to the first compressor to receive refrigerant compressed by the first compressor;
- an ejector having:
  - a primary inlet coupled to the heat rejection heat exchanger to receive refrigerant;
  - a secondary inlet; and
  - an outlet;
- a separator having:
  - an inlet coupled to the outlet of the ejector to receive refrigerant from the ejector;
  - a gas outlet coupled to the first compressor to return refrigerant to the first compressor; and
  - a liquid outlet coupled to the secondary inlet of the ejector to deliver refrigerant to the ejector;
- a heat absorption heat exchanger between the liquid outlet of the separator and the ejector secondary inlet; and
- a second compressor between the heat absorption heat exchanger and the ejector secondary inlet, wherein the ejector is a first ejector and the separator is a first separator and the system further comprises:
- a second separator having:
  - an inlet;
  - a gas outlet coupled to the secondary inlet of the first ejector via the second compressor; and
  - a liquid outlet; and
- a second ejector having:
  - a primary inlet coupled to the liquid outlet of the first separator to receive refrigerant;
  - a secondary inlet coupled to the outlet of the heat absorption heat exchanger; and
  - an outlet coupled to the inlet of the second separator.

2. The system of claim 1 wherein:
the first and second separators are gravity separators.

3. The system of claim 1 further comprising:
an expansion device immediately upstream of the heat absorption heat exchanger inlet.

4. The system of claim 1 wherein:
the system has no other separator.

5. The system of claim 1 wherein:
the system has no other ejector.

6. The system of claim 1 wherein:
the system has no other compressor.

7. The system of claim 1 wherein:
the first compressor is a reciprocating compressor; and
the second compressor is a reciprocating compressor.

8. The system of claim 1 wherein:
the first compressor is separately controlled relative to the second compressor.

9. The system of claim 1 wherein:
the second compressor has a pressure ratio less than a pressure ratio of the first compressor.

10. The system of claim 1 wherein:
refrigerant comprises at least 50% carbon dioxide, by weight.

11. A method for operating the system of claim 1 comprising running the first and second compressors in a first mode wherein:
- the refrigerant is compressed in the first compressor;

refrigerant received from the first compressor by the heat rejection heat exchanger rejects heat in the heat rejection heat exchanger to produce initially cooled refrigerant;

the initially cooled refrigerant passes through the ejector; and a liquid discharge of the separator passes via the second compressor to the ejector secondary inlet.

12. The method of claim 11 wherein:

a pressure ratio of the second compressor is 10-80% of a pressure ratio of the first compressor; and a pressure increase across the second compressor is 5-45% of a pressure increase across the first compressor.

* * * * *